US012104813B2

(12) United States Patent
Michaelis

(10) Patent No.: US 12,104,813 B2
(45) Date of Patent: Oct. 1, 2024

(54) METHOD AND SYSTEM FOR IDENTIFYING INDOOR AIR QUALITY (IAQ) MONITOR INSTALLATION LOCATION

(71) Applicant: LENNOX INDUSTRIES INC., Richardson, TX (US)

(72) Inventor: Calvin Michaelis, Carrollton, TX (US)

(73) Assignee: Lennox Industries Inc., Richardson, TX (US)

( * ) Notice: Subject to any disclaimer, the term of this patent is extended or adjusted under 35 U.S.C. 154(b) by 330 days.

(21) Appl. No.: 17/825,020

(22) Filed: May 26, 2022

(65) Prior Publication Data

US 2023/0383978 A1 Nov. 30, 2023

(51) Int. Cl.
*F24F 11/49* (2018.01)
*F24F 11/88* (2018.01)
*F24F 110/50* (2018.01)

(52) U.S. Cl.
CPC ..... *F24F 11/49* (2018.01); *F24F 11/88* (2018.01); *F24F 2110/50* (2018.01)

(58) Field of Classification Search
CPC ..... F24F 11/49; F24F 11/88; F24F 2110/50; F24F 11/89; F24F 11/52; F24F 11/30
See application file for complete search history.

(56) References Cited

U.S. PATENT DOCUMENTS 5,394,934 A * 3/1995 Rein ..... F24F 11/30 165/200
10,767,879 B1 9/2020 Burnett
2013/0260668 A1* 10/2013 Stakutis ..... F24F 11/74 454/256
2017/0130981 A1 5/2017 Willette et al.

* cited by examiner

*Primary Examiner* — Xin Y Zhong

(57) ABSTRACT

A method of monitoring a heating, ventilation, and air conditioning (HVAC) system to detect installation location of at least one indoor air quality (IAQ) monitor. The method includes monitoring, by a controller, operation of the HVAC system, determining, by the controller, whether power exists at a duct terminal of the at least one IAQ monitor and responsive to a determination that the power exists at the duct terminal of the at least one IAQ monitor, configuring, the at least one IAQ monitor as being installed within a ductwork.

20 Claims, 6 Drawing Sheets

METHOD AND SYSTEM FOR IDENTIFYING INDOOR AIR QUALITY (IAQ) MONITOR INSTALLATION LOCATION

TECHNICAL FIELD

The present invention relates generally to heating, ventilation, and air conditioning (HVAC) systems and, more particularly, but not by way of limitation, to identifying installation location of indoor air quality (IAQ) monitors within the HVAC system.

HISTORY OF RELATED ART

HVAC systems are used to regulate environmental conditions within an enclosed space. Typically, HVAC systems have a circulation fan that pulls air from the enclosed space through ducts and pushes the air back into the enclosed space through additional ducts after conditioning the air (e.g., heating, cooling, humidifying, or dehumidifying the air).

SUMMARY OF THE INVENTION

A method of monitoring a heating, ventilation, and air conditioning (HVAC) system to detect installation location of at least one indoor air quality (IAQ) monitor. The method includes monitoring, by a controller, operation of the HVAC system, determining, by the controller, whether power exists at a duct terminal of the at least one IAQ monitor and responsive to a determination that the power exists at the duct terminal of the at least one IAQ monitor, configuring, the at least one IAQ monitor as being installed within a ductwork.

A heating, ventilation, and air conditioning (HVAC) system includes at least one indoor air quality (IAQ) monitor positioned within at least one of a ductwork of the HVAC system and an enclosed space and a controller. The controller is configured to monitor operation of the HVAC system, determine whether power exists at a duct terminal of the at least one IAQ monitor and responsive to a determination that the power exists at the duct terminal of the at least one IAQ monitor, configure, the at least one IAQ monitor as being installed within the ductwork.

A heating, ventilation, and air conditioning (HVAC) system includes at least one indoor air quality (IAQ) monitor positioned within at least one of a ductwork of the HVAC system and an enclosed space and a controller. The controller is configured to monitor operation of the HVAC system, determine whether power exists at a duct terminal of the at least one IAQ monitor, responsive to a determination that the power exists at the duct terminal of the at least one IAQ monitor, configure, the at least one IAQ monitor as being installed within the ductwork and responsive to a determination that the duct terminal of the at least one IAQ monitor does not receive power, configure, the at least one IAQ monitor as being installed within the enclosed space.

BRIEF DESCRIPTION OF THE DRAWINGS

A more complete understanding of embodiments of the present invention may be obtained by reference to the following Detailed Description when taken in conjunction with the accompanying Drawings wherein.

DETAILED DESCRIPTION OF ILLUSTRATIVE EMBODIMENTS

To direct operations of the circulation fan and other components, each HVAC system includes at least one controller. In addition to directing the operation of the HVAC system, the at least one controller may also be used to monitor various components, also referred to as equipment, of the HVAC system to determine if the HVAC system components are functioning appropriately. Additionally, the at least one controller may also be used to identify locations of the HVAC system components within the HVAC system.

Figure 1:
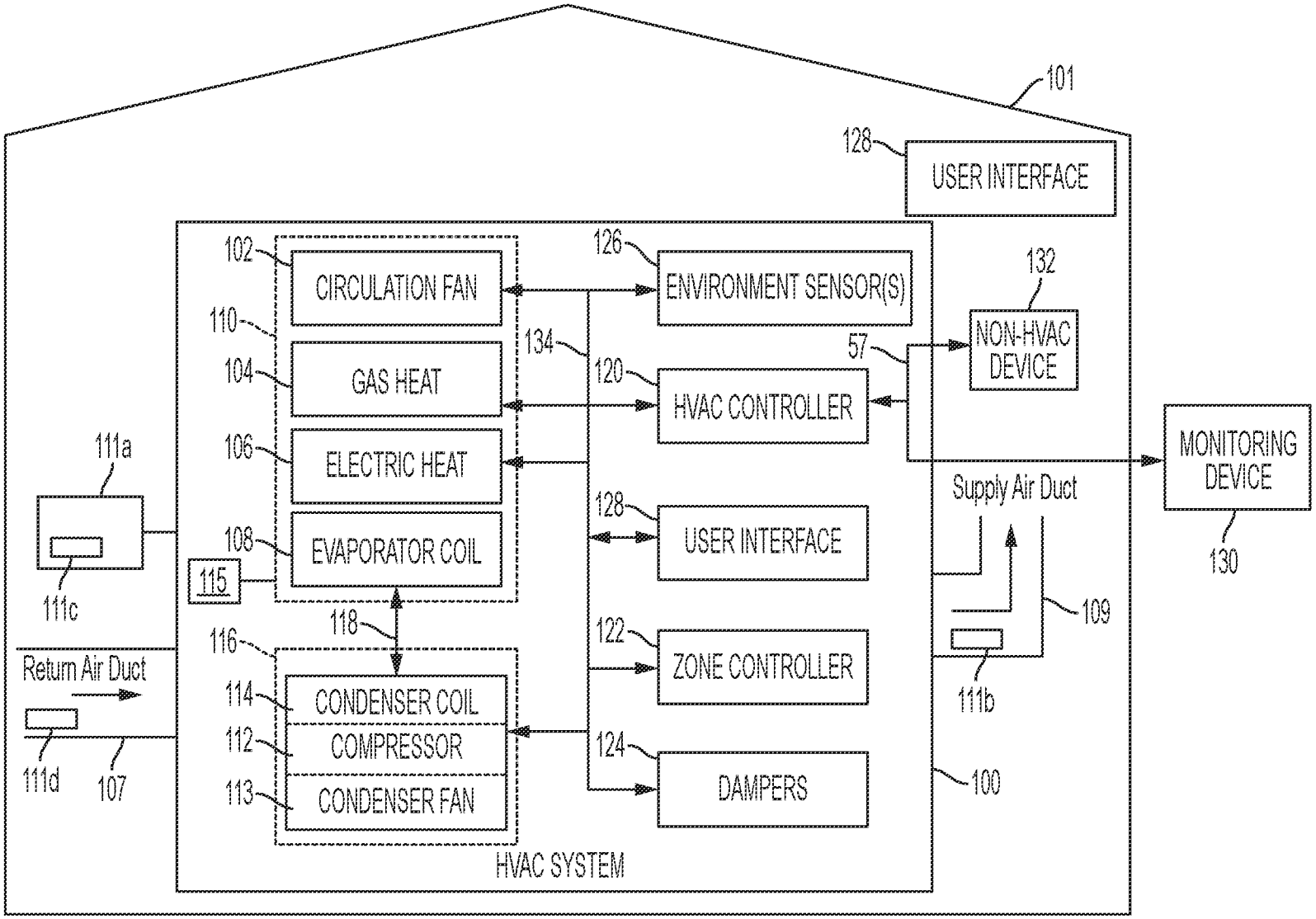
FIG. 1 is a block diagram of an illustrative HVAC system.

FIG. 1 illustrates an HVAC system 100. In a typical embodiment, the HVAC system 100 is a networked HVAC system configured to condition air via, for example, heating, cooling, humidifying, or dehumidifying. The HVAC system 100 can be a residential system or a commercial system such as, for example, a roof top system. For illustration, the HVAC system 100 as illustrated in FIG. 1 includes various components; however, in other embodiments, the HVAC system 100 may include additional components that are not illustrated but typically included within HVAC systems. Typically, a building, house, or other structure 101 includes the HVAC system 100.

The HVAC system 100 includes a circulation fan 102, a gas heat section 104, electric heat section 106, and a refrigerant evaporator coil 108 all typically associated with the circulation fan 102. The circulation fan 102, the gas heat section 104, the electric heat section 106, and the refrigerant evaporator coil 108 are collectively referred to as an "indoor unit" 110. In a typical embodiment, the circulation fan 102 may be a multi-speed or variable-speed circulation fan and the gas heat section 104 may be one or more stages or modulating heat output. In a typical embodiment, the indoor unit 110 is located within, or in close proximity to, an enclosed space 111*a*. In a typical embodiment, the indoor unit 110 is powered via a power supply 115. The HVAC system 100 also includes a compressor 112, an associated condenser coil 114, and a condenser fan 113, which are typically referred to as an "outdoor unit" 116. In a typical embodiment, the condenser fan 113 may be at least one of a fixed-speed condenser fan, a multi-speed condenser fan, or a variable-speed condenser fan. In some embodiments, the HVAC system 100 includes a reversing valve (not illustrated) to allow operation in a compressor heating mode. In various embodiments, the outdoor unit 116 is, for example, a rooftop unit or a ground-level unit. The compressor 112 and the associated condenser coil 114 are connected to an associated evaporator coil 108 by a refrigerant line 118. In a typical embodiment, the compressor 112 is, for example, a single-stage compressor, a multi-stage compressor, or a variable-speed compressor. The circulation fan 102, sometimes referred to as a blower, is configured to operate at different capacities (i.e., variable motor speeds) to circulate air through the HVAC system 100, whereby the circulated air is conditioned and supplied to the enclosed space 111*a* via a system of ductwork and air vents including return air duct 107 and supply air duct 109.

Still referring to FIG. 1, the HVAC system 100 includes an HVAC controller 120 that is configured to control operation of the various components of the HVAC system 100 such as, for example, the circulation fan 102, the gas heat section 104, the electric heat section 106, the compressor 112, and the condenser fan 113. In some embodiments, the HVAC system 100 can be a zoned system. In such embodiments, the HVAC system 100 includes a zone controller 122, dampers 124, and a plurality of environment sensors 126. The plurality of environment sensors 126 may be, for example, outside air temperature (OAT) sensors that are configured to measure outdoor air temperature, DAT sensors that are configured to measure HVAC air-duct discharge air temperature, indoor air temperature (IAT) sensors (e.g., room temperature sensors), and the like. In a typical embodiment, the HVAC controller 120 cooperates with the zone controller 122 and the dampers 124 to regulate the environment of the enclosed space 111*a*.

The HVAC controller 120 may be an integrated controller or a distributed controller that directs operation of the HVAC system 100. In a typical embodiment, the HVAC controller 120 includes an interface to receive, for example, thermostat demands, component health data, temperature setpoints, blower control signals, environmental conditions, and operating mode status for various zones of the HVAC system 100. In a typical embodiment, the HVAC controller 120 also includes a processor and a memory to direct operation of the HVAC system 100 including, for example, a speed of the circulation fan 102.

Still referring to FIG. 1, in some embodiments, the plurality of environment sensors 126 are associated with the HVAC controller 120 and also optionally associated with a user interface 128. In some embodiments, the user interface 128 provides additional functions such as, for example, operational, diagnostic, status message display, and a visual interface that allows at least one of an installer, a user, a support entity, and a service provider to perform actions with respect to the HVAC system 100. In some embodiments, the user interface 128 is, for example, a thermostat of the HVAC system 100. In other embodiments, the user interface 128 is associated with at least one sensor of the plurality of environment sensors 126 to determine the environmental condition information and communicate that information to the user. The user interface 128 may also include a display, buttons, a microphone, a speaker, or other components to communicate with the user. Additionally, the user interface 128 may include a processor and memory that is configured to receive user-determined parameters, and calculate operational parameters of the HVAC system 100 as disclosed herein.

In a typical embodiment, the HVAC system 100 is configured to communicate with a plurality of devices such as, for example, a monitoring device 130, a communication device 132, and the like. In a typical embodiment, the monitoring device 130 is not part of the HVAC system. For example, the monitoring device 130 is a server or computer of a third party such as, for example, a manufacturer, a support entity, a service provider, and the like. In other embodiments, the monitoring device 130 is located at an office of, for example, the manufacturer, the support entity, the service provider, and the like.

In a typical embodiment, the communication device 132 is a non-HVAC device having a primary function that is not associated with HVAC systems. For example, non-HVAC devices include mobile-computing devices that are configured to interact with the HVAC system 100 to monitor and modify at least some of the operating parameters of the HVAC system 100. Mobile computing devices may be, for example, a personal computer (e.g., desktop or laptop), a tablet computer, a mobile device (e.g., smart phone), and the like. In a typical embodiment, the communication device 132 includes at least one processor, memory and a user interface, such as a display. One skilled in the art will also understand that the communication device 132 disclosed herein includes other components that are typically included in such devices including, for example, a power supply, a communications interface, and the like.

The zone controller 122 is configured to manage movement of conditioned air to designated zones of the enclosed space 111*a*. The zone-controlled HVAC system 100 allows the user to independently control the temperature in the designated zones. In a typical embodiment, the zone controller 122 operates the dampers 124 to control air flow to the zones of the enclosed space 111*a*.

In some embodiments, a data bus 134, which in the illustrated embodiment is a serial bus, couples various components of the HVAC system 100 together such that data is communicated therebetween. In a typical embodiment, the data bus 134 may include, for example, any combination of hardware, software embedded in a computer readable medium, or encoded logic incorporated in hardware or otherwise stored (e.g., firmware) to couple components of the HVAC system 100 to each other. As an example and not by way of limitation, the data bus 134 may include an Accelerated Graphics Port (AGP) or other graphics bus, a Controller Area Network (CAN) bus, a front-side bus (FSB), a HYPERTRANSPORT (HT) interconnect, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or any other suitable bus or a combination of two or more of these. In various embodiments, the data bus 134 may include any number, type, or configuration of data buses 134, where appropriate. In particular embodiments, one or more data buses 134 (which may each include an address bus and a data bus) may couple the HVAC controller 120 to other components of the HVAC system 100. In other embodiments, connections between various components of the HVAC system 100 are wired. For example, conventional cable and contacts may be used to couple the HVAC controller 120 to the various components. In some embodiments, a wireless connection is employed to provide at least some of the connections between components of the HVAC system such as, for example, a connection between the HVAC controller 120 and the circulation fan 102 or the plurality of environment sensors 126.

In addition to providing basic airflow and air temperature controls for conventional elements, the HVAC system 100 may also include at least one Indoor Air Quality (IAQ) monitor 111*b*, 111*c*, 111*d* capable of improving and/or altering quality of air circulating within the structure 101. In some embodiments, the at least one IAQ monitor 111*b*, 111*c*, 111*d* may be coupled to the HVAC system 100 via ductwork such as, for example, the return air duct 107 or the supply air duct 109. In other embodiments, the at least one IAQ monitor 111*b*, 111*c*, 111*d* may be integrated into or otherwise coupled to other HVAC components such as, for example, the user interface 128 or may be standalone devices positioned within the enclosed space 111*a*.

In various implementations, the at least one IAQ monitor 111*b*, 111*c*, 111*d* may have one or more sensors configured to detect the IAQ monitor's status, operational conditions, or any other information related to the IAQ monitor such as, for example, the status of components (e.g., performance components) that require maintenance or replacement. To detect the foregoing, these sensors may be equipped to measure any number of parameters over time including, but not limited to, temperature, pressure, airflow, noise, sounds (audible and/or inaudible), voltage, current, resistance, capacitance, humidity, electromagnetic radiation (visible and/or invisible), bioaresosols, Volatile Organic Compounds (VOCs), other airborne components, and the like. These parameters may provide a direct indication of the status of at least one IAQ monitor 111*b*, 111*c*, 111*d* (e.g., the current drawn by a photo catalytic device, or the light generated by an ultraviolet (UV) light source). Alternatively, the parameters may provide an indirect indication from which the status of the at least one IAQ monitor 111*b*, 111*c*, 111*d* may be inferred (e.g., changes in airflow or VOCs downstream of an air filter).

Currently, the user has the capability of manually identifying a location of the at least one IAQ monitor 111*b*, 111*c*, 111*d* within the HVAC system 100. Additionally, the user has the capability of inadvertently changing a setting identifying the location of the at least one IAQ monitor 111*b*, 111*c*, 111*d* resulting in air quality determination measurement errors. In an effort to avoid air quality determination measurement errors, it is important to eliminate the capability of the user from inadvertently changing the setting identifying the location of the at least one IAQ monitor 111*b*, 111*c*, 111*d*. Exemplary embodiments disclose a hardware approach to identify installation location of the at least one IAQ monitor 111*b*, 111*c*, 111*d* within the HVAC system 100 that eliminates the user from inadvertently changing the setting identifying the location of the at least one IAQ monitor 111*b*, 111*c*, 111*d*.

Figure 2:
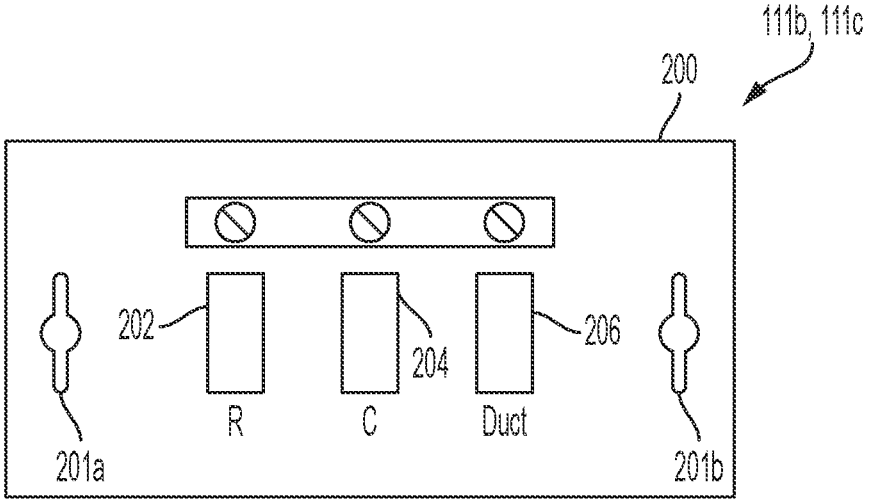
FIG. 2 is a rear view of an illustrative mounting bracket for an indoor air quality (IAQ) monitor.

FIG. 2 illustrates a rear view of a mounting bracket 200 for the at least one IAQ monitor 111*b*, 111*c*, 111*d*. For illustrative purposes, FIG. 2 will be described herein relative to FIG. 1. The mounting bracket 200 includes a plurality of mounting tabs 201*a*, 201*b*. The mounting tabs 201*a*, 201*b* allow for mounting the mounting bracket 200 via screws, rivets, nuts, or bolts to a mounting location such as, for example, a wall or ductwork (e.g., the return air duct 107 or the supply air duct 109). For illustrative purposes, only two mounting tabs 201*b*, 201*b* are disclosed; however, the mounting bracket 200 can include any number of mounting tabs as dictated by design requirements. The mounting bracket 200 further includes a plurality of input terminals. In a typical embodiment, the mounting bracket 200 includes three input terminals designated as R terminal 202 (e.g., first input terminal), C terminal 204 (e.g., second input terminal), and a duct terminal 206 (e.g., third input terminal). The R terminal is a 24V hot terminal that receives an input from the 24V alternating current (AC) transformer 115 of the HVAC system 100 and is configured to power the at least one IAQ monitor 111*b*, 111*c*, 111*d*. The C terminal 204 is a 24V common as opposed to the 24V hot terminal. The C terminal 204 is configured to provide a path back to the 24V transformer of the HVAC system 100. The duct terminal 206 provides a signal to the HVAC controller 120 that represents a location of the at least one IAQ monitor 111*b*, 111*c*, 111*d* within the HVAC system 100 based upon whether the duct terminal 206 is powered or not.

Figure 3A:
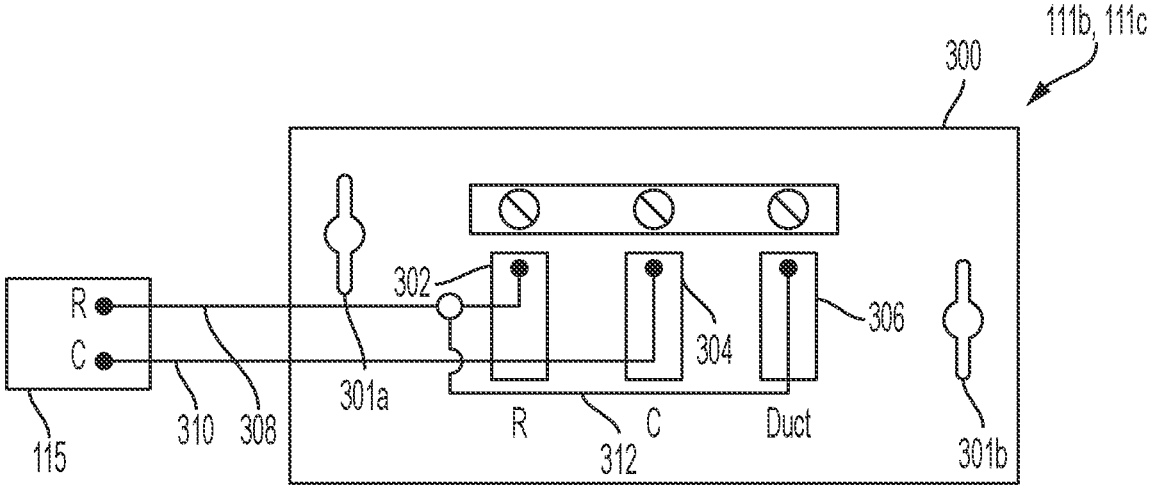
FIGS. 3A-3B illustrate a rear view of the illustrative mounting bracket for the IAQ monitor along with wiring representation for a residential system according to an exemplary embodiment.
Figure 3B:
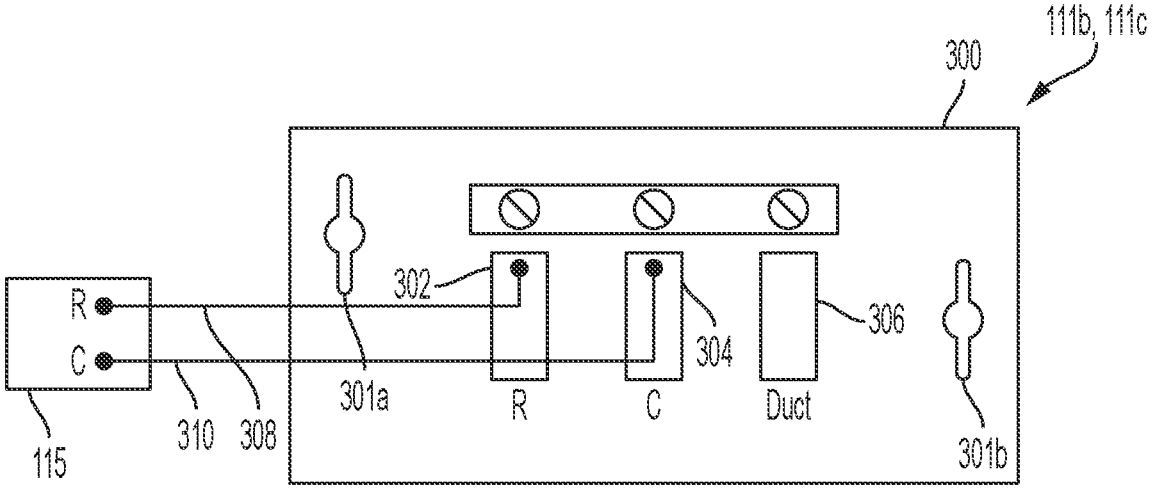

FIGS. 3A-3B illustrate a rear view of a mounting bracket 300 for the at least one IAQ monitor 111*b*, 111*c*, 111*d*, along with wiring representation for a residential system according to an exemplary embodiment. For illustrative purposes, FIGS. 3A-3B will be described herein relative to FIGS. 1-2. In residential systems, the at least one IAQ monitor 111*b*, 111*c*, 111*d* has the option of being installed within the enclosed space 111*a* (e.g., a wall) or in the attic for mounting within the ductwork (e.g., the return air duct 107 or the supply air duct 109).

In FIGS. 3A-3B, the mounting bracket 300 includes a plurality of mounting tabs 301*a*, 301*b*. The mounting tabs 301*a*, 301*b* allow for mounting the mounting bracket 300 via screws, rivets, nuts, or bolts to a mounting location such as, for example, within the enclosed space 111*a* (e.g., a wall) or the ductwork (e.g., the return air duct 107 or the supply air duct 109). For illustrative purposes, only two mounting tabs 301*b*, 301*b* are disclosed; however, the mounting bracket 300 can include any number of mounting tabs as dictated by design requirements. The mounting bracket 300 further includes a plurality of input terminals. In a typical embodiment, the mounting bracket 300 includes three input terminals designated as R terminal 302 (e.g., first input terminal), C terminal 304 (e.g., second input terminal), and a duct terminal 306 (e.g., third input terminal). The R terminal is a 24 V hot terminal that receives an input from the 24V alternating current (AC) transformer 115 of the HVAC system 100 and is configured to power the at least one IAQ monitor 111*b*, 111*c*, 111*d*. The C terminal 304 is a 24 VAC common as opposed to the 24 VAC hot terminal that originates from the 24 VAC transformer 115 of the HVAC system 100. The C terminal 204 is configured to provide a path back to the 24 VAC transformer of the HVAC system 100. The duct terminal 306 is monitored by the HVAC controller 120 via an interface to determine presence of power. The presence or absence of power at the duct terminal 306 indicates the location of the at least one IAQ monitor 111*b*, 111*c*, 111*d* within the HVAC system 100.

Exemplary wiring representation illustrated in FIG. 3A illustrates an embodiment in which the at least one IAQ monitor 111*b*, 111*c*, 111*d* is installed within the ductwork (e.g., the return air duct 107 or the supply air duct 109). In a typical embodiment, the duct terminal 306 is powered through the R terminal via an electrical wire such as, for example, a jumper wire 312. Since the R terminal is a 24 VAC hot terminal that receives an input from the 24 VAC transformer 115 of the HVAC system 100, the duct terminal 306 which is powered through the R terminal will also receive 24 VAC. In a typical embodiment, the duct terminal 306 is monitored by the HVAC controller 120 to determine presence of power (e.g., 24 VAC) at the duct terminal 306. Presence of power (e.g., 24 VAC) at the duct terminal 306 is an indication that the at least one IAQ monitor 111*b*, 111*c*, 111*d* is installed within the ductwork (e.g., the return air duct 107 or the supply air duct 109). Absence of power (e.g., 24 VAC) at the duct terminal 306 is an indication that the at least one IAQ monitor 111*b*, 111*c*, 111*d* is not installed within the ductwork. Once the installation location of the at least one IAQ monitor 111*b*, 111*c*, 111*d* is determined, the at least one IAQ monitor 111*b*, 111*c*, 111*d* is configured as either a duct or wall install for proper air flow and air quality determinations.

Exemplary wiring representation illustrated in FIG. 3B illustrates the embodiment in which the at least one IAQ monitor 111*b*, 111*c*, 111*d* is installed within the enclosed space 111*a* (e.g., a wall). In a typical embodiment, the duct terminal 306 is monitored by the HVAC controller 120 to determine presence of power (e.g., 24 VAC) at the duct terminal 206. In a typical embodiment, the duct terminal 306 is illustrated as having no connection thereby having no power. Absence of power at the duct terminal 306 is an indication that the at least one IAQ monitor 111*b*, 111*c*, 111*d* is installed within the enclosed space 111*a* (e.g., a wall) and not within the ductwork. Once the installation location of the at least one IAQ monitor 111*b*, 111*c*, 111*d* is determined, the at least one IAQ monitor 111*b*, 111*c*, 111*d* is configured as either a duct or wall install for proper air flow and air quality determinations.

For a commercial system such as, for example, a roof top system, two IAQ monitors 111*b*, 111*d* are required to be installed in the ductwork. For example, a first IAQ monitor 111*d* is installed in the return air duct 107 while a second IAQ monitor 111*b* is installed in the supply air duct 109. In a typical embodiment, the duct terminal 306 of the first IAQ monitor 111*d* installed in the return air duct 107 is powered through the R terminal via an electrical wire such as, for example, a jumper wire 312. Since the R terminal is a 24 VAC hot terminal that receives an input from the 24 VAC transformer 115 of the HVAC system 100, the duct terminal 306 which is powered through the R terminal will also receive 24 VAC. The duct terminal 306 of the second IAQ monitor 111*b* installed in the supply air duct 109 is not powered and thereby has no power. Presence of power (e.g., 24 VAC) at the duct terminal 306 of the first IAQ monitor 111*d* is an indication that the first IAQ monitor 111*d* is installed within the return air duct 107. Absence of power (e.g., 24 VAC) at the duct terminal 306 of the second IAQ monitor 111*b* is an indication that the second IAQ monitor 111*b* is installed within the supply air duct 109.

Figure 4A:
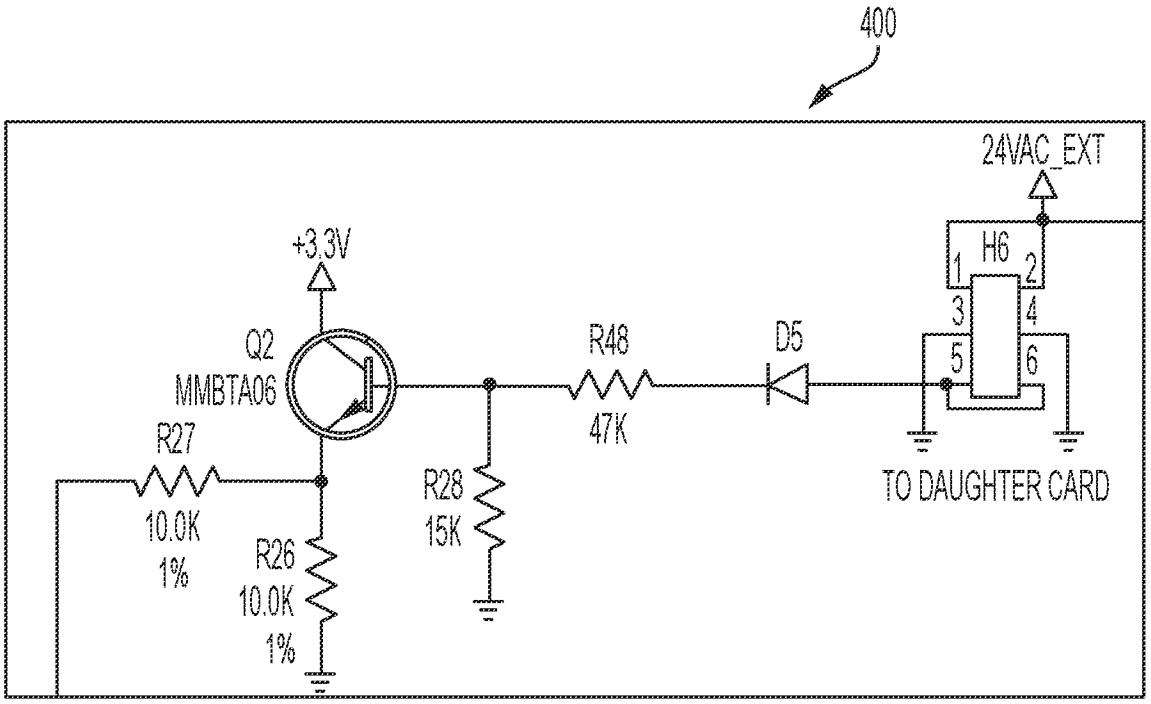
FIG. 4A is a schematic diagram of a circuit according to an exemplary embodiment.
Figure 4B:
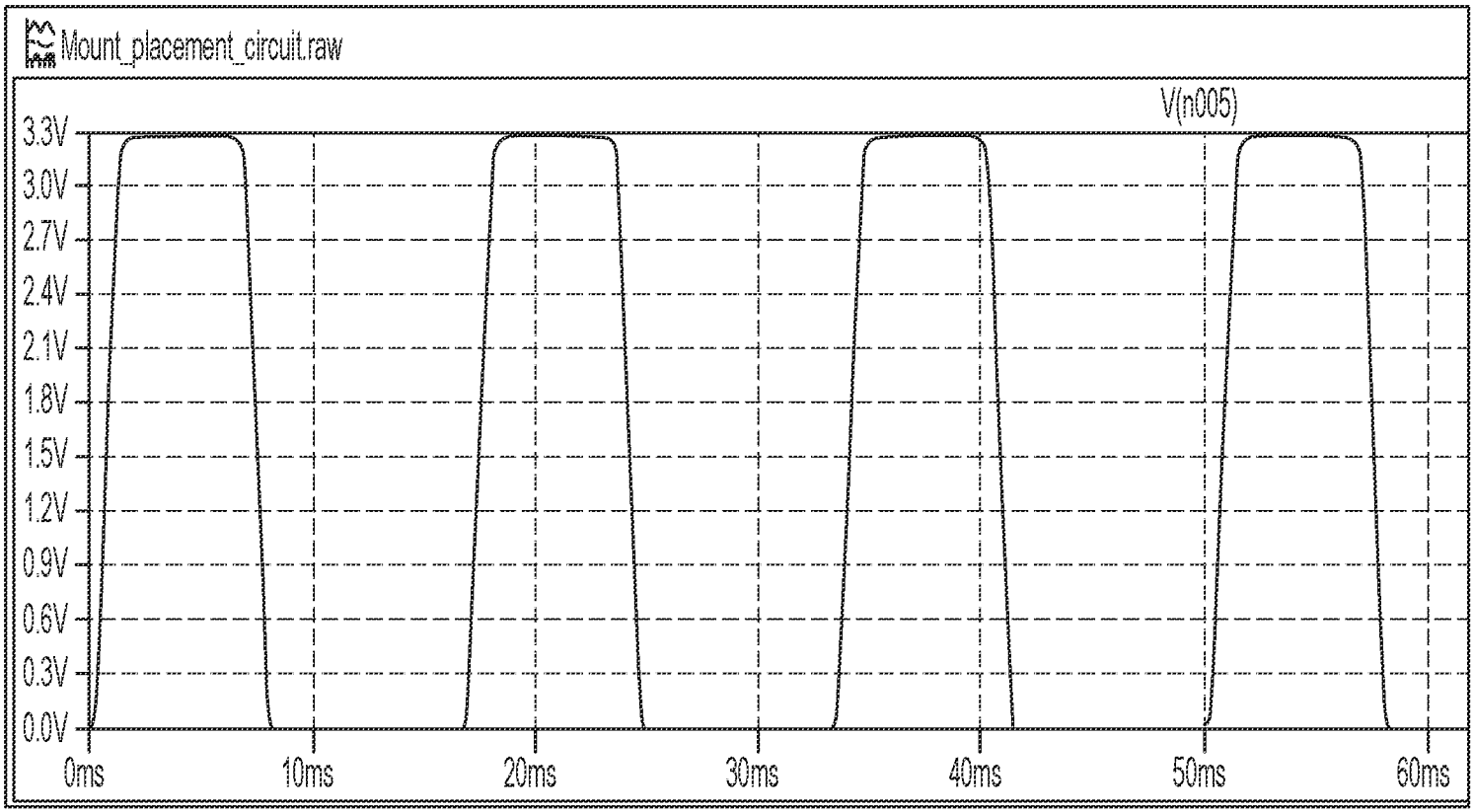
FIG. 4B is a graphical representation of voltage plots associated with the circuit 400 of FIG. 4A.

FIG. 4A is a schematic diagram of a circuit 400 according to an exemplary embodiment. FIG. 4B is a graphical representation of voltage plots associated with the circuit 400 of FIG. 4A. For illustrative purposes, FIGS. 4A-4B will be described herein relative to FIGS. 1-3B. The power circuit 400 includes at least one diode D5, at least one transistor such as, for example, a bipolar junction transistor (BJT) Q2, a plurality of resistors R26, R27, R28, R48, and an input power harness H6. Pins 1-2 of the input power harness H6 are connected to the 24 VAC transformer 115 and provides power to the at least one IAQ monitor 111*b*, 111*c*, 111*d*. Pins 3-4 of the input power harness H6 are connected to ground. Pins 5-6 of the input power harness H6 are connected to the circuit interface of the circuit 400. A mating harness that plugs into the header H6 is configured to populate a 24 VAC for pins 1-2 and ground for pins 3-4 thereby supplying power to the at least one IAQ monitor 111*b*, 111*c*, 111*d*.

In residential systems, for embodiments in which the at least one IAQ monitor 111*b*, 111*c*, 111*d* is installed within the ductwork (e.g., the return air duct 107 or the supply air duct 109), the mating harness includes an additional wire with 24 VAC that connects to pins 5-6 of the input power harness H6. When the 24 VAC sine wave is positive, the BJT 42 powers ON pulling an emitter terminal to +3.3V. As a result, the HVAC controller 120 will recognize the presence of the 24 VAC and will always read logic high and then configure the at least one IAQ monitor 111*b*, 111*c*, 111*d* as being installed within the ductwork (e.g., the return air duct 107 or the supply air duct 109). For embodiments in which the at least one IAQ monitor 111*b*, 111*c*, 111*d* is installed within the enclosed space 111*a* (e.g., a wall), the mating harness will not have the additional wire with 24 VAC for connection to pins 5-6 of the input power harness H6. As a result, the HVAC controller 120 will not recognize the presence of the 24 VAC and will always read logic low and then configure the at least one IAQ monitor 111*b*, 111*c*, 111*d* as being installed within the enclosed space 111*a* (e.g., a wall). The same circuit 400 is used for commercial systems such as, for example, a roof top system.

Figure 5:
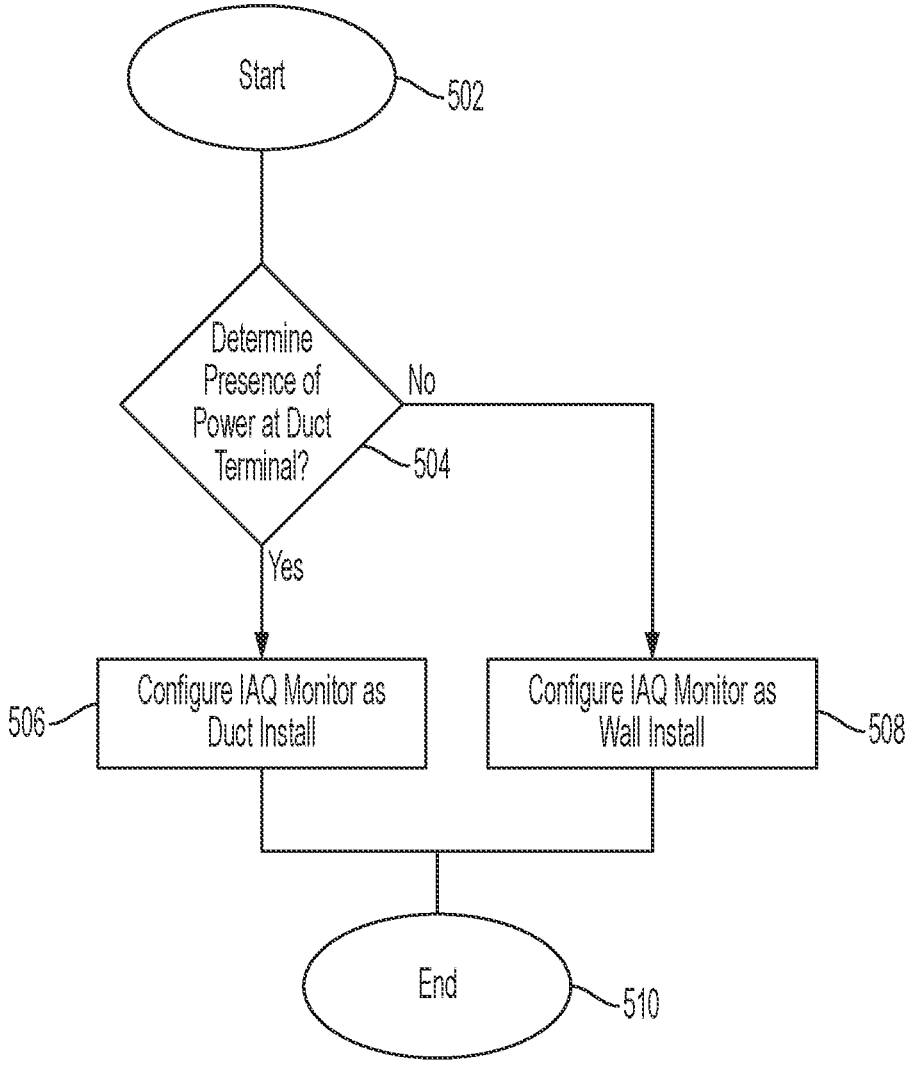
FIG. 5 is a flow diagram illustrating a process to determine installation location of the IAQ monitor in a residential HVAC system according to an exemplary embodiment.

FIG. 5 is a flow diagram illustrating a process 500 to determine installation location of an IAQ monitor in a residential HVAC system 100. For illustrative purposes, the process 500 will be described herein relative to FIGS. 1 and 3A-3B. In residential systems, the at least one IAQ monitor 111*b*, 111*c*, 111*d* has the option of being installed within the enclosed space 111*a* (e.g., a wall) or in the attic for mounting within the ductwork (e.g., the return air duct 107 or the supply air duct 109). The process 500 starts at step 502. At step 504, the HVAC controller 120 determines presence of power at the duct terminal 306 (e.g., third input terminal) which is positioned on a rear side of the mounting bracket 300 of the at least one IAQ monitor 111*b*, 111*c*, 111*d*. Presence of power (e.g., 24 VAC) at the duct terminal 306 is an indication that the at least one IAQ monitor 111*b*, 111*c*, 111*d* is installed within the ductwork (e.g., the return air duct 107 or the supply air duct 109). In a typical embodiment, the duct terminal 306 is powered through the R terminal via an electrical wire such as, for example, a jumper wire 312. Since the R terminal is a 24 VAC hot terminal that receives an input from the 24 VAC transformer 115 of the HVAC system 100, the duct terminal 306 which is powered through the R terminal will also receive 24 VAC.

If it is determined as step 504 that the HVAC controller 120 detects presence of power at the duct terminal 306, the process 500 proceeds to step 506. At step 506, the at least one IAQ monitor 111*b*, 111*c*, 111*d* is configured as a duct install (e.g., the return air duct 107 or the supply air duct 109) for proper air flow and air quality determinations. However, if it is determined as step 504 that the HVAC controller 120 does not detect presence of power at the duct terminal 306, the process 500 proceeds to step 508. At step 508, the at least one IAQ monitor 111*b*, 111*c*, 111*d* is configured as being installed within the enclosed space 111*a* (e.g., a wall). Absence of power at the duct terminal 306 is an indication that the at least one IAQ monitor 111*b*, 111*c*, 111*d* is installed within the enclosed space 111*a* (e.g., a wall) and not within the ductwork. From steps 506, and 508, the process 500 ends at step 510.

Figure 6:
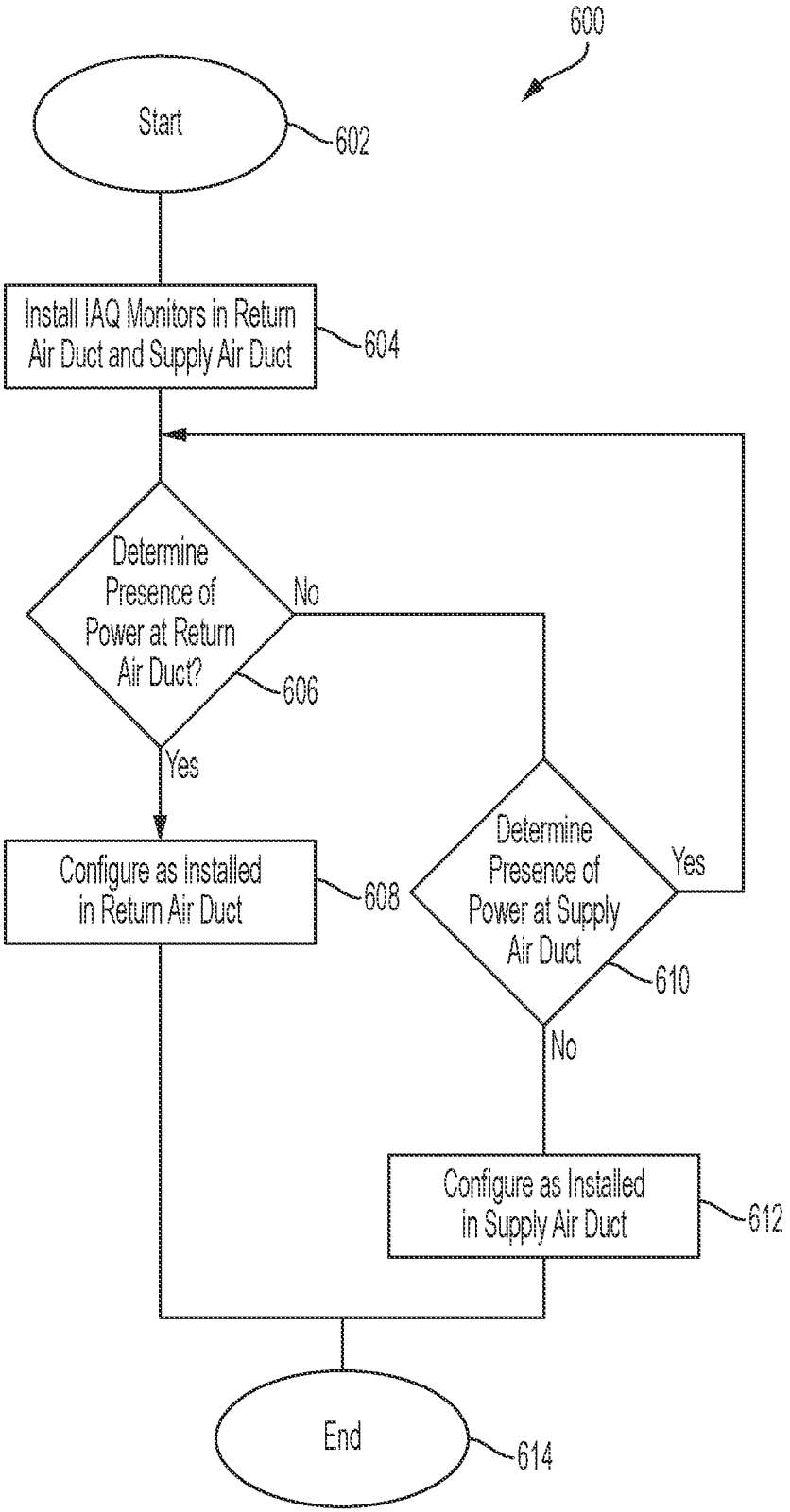
FIG. 6 is a flow diagram illustrating a process to determine installation location of the IAQ monitor in a commercial HVAC system according to an exemplary embodiment.

FIG. 6 is a flow diagram illustrating a process 600 to determine installation location of an IAQ monitor in a commercial HVAC system 100 such as, for example, a roof top system. For illustrative purposes, the process 600 will be described herein relative to FIGS. 1 and 3A-3B. The process 600 starts at step 602. At step 604, two IAQ monitors 111*b*, 111*d* are installed in the ductwork. For example, a first IAQ monitor 111*d* is installed in the return air duct 107 while a second IAQ monitor 111*b* is installed in the supply air duct 109. At step 606, the HVAC controller 120 determines presence of power at the duct terminal 306 of the first IAQ monitor 111*d* installed in the return air duct 107. Presence of power (e.g., 24 VAC) at the duct terminal 306 of the first IAQ monitor 111*d* installed in the return air duct 107 is an indication that first IAQ monitor 111*d* of the two IAQ monitors 111*b*, 111*d* is installed within the return air duct 107. In a typical embodiment, the duct terminal 306 is powered through the R terminal via an electrical wire such as, for example, a jumper wire 312. Since the R terminal is a 24 VAC hot terminal that receives an input from the 24 VAC transformer 115 of the HVAC system 100, the duct terminal 306 which is powered through the R terminal will also receive 24 VAC. From step 606, the process 600 proceeds to step 608. At step 608, the first IAQ monitor 111*d* is configured as being installed in the return air duct 107 for proper air flow and air quality determinations.

However, if it is determined as step 606 that the HVAC controller 120 does not detect presence of power at the duct terminal 306 of the first IAQ monitor 111*d*, the process 600 proceeds to step 610. At step 610, the HVAC controller 120 determines presence or absence of power at the duct terminal 306 of the second IAQ monitor 111*b* installed in the supply air duct 109. Absence of power at the duct terminal 306 of the second IAQ monitor 111*b* (step 610) is an indication that the second IAQ monitor 111*b* of the two IAQ monitors 111*b*, 111*d* is installed within the supply air duct 109. At step 612, the second IAQ monitor 111*b* is configured as being installed in the supply air duct 107 for proper air flow and air quality determinations. If at step 610, the HVAC controller 120 determines presence of power at the duct terminal 306 of the second IAQ monitor 111*b*, the process 600 returns to step 606. From steps 608 and 612, the process 600 ends at step 614.

For purposes of this patent application, the term computer-readable storage medium encompasses one or more tangible computer-readable storage media possessing structures. As an example and not by way of limitation, a computer-readable storage medium may include a semiconductor-based or other integrated circuit (IC) (such as, for example, a field-programmable gate array (FPGA) or an application-specific IC (ASIC)), a hard disk, an HDD, a hybrid hard drive (HHD), an optical disc, an optical disc drive (ODD), a magneto-optical disc, a magneto-optical drive, a floppy disk, a floppy disk drive (FDD), magnetic tape, a holographic storage medium, a solid-state drive (SSD), a RAM-drive, a SECURE DIGITAL card, a SECURE DIGITAL drive, a flash memory card, a flash memory drive, or any other suitable tangible computer-readable storage medium or a combination of two or more of these, where appropriate.

Particular embodiments may include one or more computer-readable storage media implementing any suitable storage. In particular embodiments, a computer-readable storage medium implements one or more portions of the processor, one or more portions of the system memory, or a combination of these, where appropriate. In particular embodiments, a computer-readable storage medium implements RAM or ROM. In particular embodiments, a computer-readable storage medium implements volatile or persistent memory. In particular embodiments, one or more computer-readable storage media embody encoded software.

In this patent application, reference to encoded software may encompass one or more applications, bytecode, one or more computer programs, one or more executables, one or more instructions, logic, machine code, one or more scripts, or source code, and vice versa, where appropriate, that have been stored or encoded in a computer-readable storage medium. In particular embodiments, encoded software includes one or more application programming interfaces (APIs) stored or encoded in a computer-readable storage medium. Particular embodiments may use any suitable encoded software written or otherwise expressed in any suitable programming language or combination of programming languages stored or encoded in any suitable type or number of computer-readable storage media. In particular embodiments, encoded software may be expressed as source code or object code. In particular embodiments, encoded software is expressed in a higher-level programming language, such as, for example, C, Python, Java, or a suitable extension thereof. In particular embodiments, encoded software is expressed in a lower-level programming language, such as assembly language (or machine code). In particular embodiments, encoded software is expressed in JAVA. In particular embodiments, encoded software is expressed in Hyper Text Markup Language (HTML), Extensible Markup Language (XML), or other suitable markup language.

Depending on the embodiment, certain acts, events, or functions of any of the algorithms described herein can be performed in a different sequence, can be added, merged, or left out altogether (e.g., not all described acts or events are necessary for the practice of the algorithms). Moreover, in certain embodiments, acts or events can be performed concurrently, e.g., through multi-threaded processing, interrupt processing, or multiple processors or processor cores or on other parallel architectures, rather than sequentially. Although certain computer-implemented tasks are described as being performed by a particular entity, other embodiments are possible in which these tasks are performed by a different entity.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, the processes described herein can be embodied within a form that does not provide all of the features and benefits set forth herein, as some features can be used or practiced separately from others. The scope of protection is defined by the appended claims rather than by the foregoing description. All changes which come within the meaning and range of equivalency of the claims are to be embraced within their scope.

Although various embodiments of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth herein.

What is claimed is:

1. A method of monitoring a heating, ventilation, and air conditioning (HVAC) system to detect installation location of at least one indoor air quality (IAQ) monitor, the method comprising:

monitoring, by a controller, operation of the HVAC system;

determining, by the controller, whether power exists at a duct terminal of the at least one IAQ monitor; and responsive to a determination that the power exists at the duct terminal of the at least one IAQ monitor, configuring, the at least one IAQ monitor as being installed within a ductwork.

2. The method of claim 1, wherein the ductwork comprises at least one of a return air duct and a supply air duct.

3. The method of claim 1, wherein:

the at least one IAQ monitor is installed within the ductwork via a mounting bracket; and wherein the mounting bracket comprises a plurality of mounting tabs.

4. The method of claim 3, wherein the mounting bracket comprises:

a first input terminal that receives power from a 24V transformer of the HVAC system;

a second terminal that is configured to provide a path back to the 24V transformer of the HVAC system; and the duct terminal provides a signal to the controller representing a location of the at least one IAQ monitor within the HVAC system based upon whether the duct terminal is powered or not.

5. The method of claim 4, wherein the duct terminal is powered via the first input terminal using an electrical wire.

6. The method of claim 5, wherein the electrical wire comprises a jumper wire.

7. The method of claim 1, further comprising:

responsive to a determination that the duct terminal of the at least one IAQ monitor does not receive power, configuring, the at least one IAQ monitor as being installed within an enclosed space.

8. The method of claim 1, wherein the HVAC system comprises a residential system.

9. A heating, ventilation, and air conditioning (HVAC) system comprising:

at least one indoor air quality (IAQ) monitor positioned within at least one of a ductwork of the HVAC system and an enclosed space;

a controller configured to:

monitor operation of the HVAC system;

determine whether power exists at a duct terminal of the at least one IAQ monitor; and responsive to a determination that the power exists at the duct terminal of the at least one IAQ monitor, configure, the at least one IAQ monitor as being installed within the ductwork.

10. The HVAC system of claim 9, wherein the ductwork comprises at least one of a return air duct and a supply air duct.

11. The HVAC system of claim 9, wherein:

the at least one IAQ monitor is installed within the ductwork via a mounting bracket; and wherein the mounting bracket comprises a plurality of mounting tabs.

12. The HVAC system of claim 11, wherein the mounting bracket comprises:

a first input terminal that receives power from a 24V transformer of the HVAC system;

a second terminal that is configured to provide a path back to the 24V transformer of the HVAC system; and the duct terminal provides a signal to the controller representing a location of the at least one IAQ monitor within the HVAC system based upon whether the duct terminal is powered or not.

13. The HVAC system of claim 12, wherein the duct terminal is powered via the first input terminal using an electrical wire.

14. The HVAC system of claim 13, wherein the electrical wire comprises a jumper wire.

15. The HVAC system of claim 9, wherein:

responsive to a determination that the duct terminal of the at least one IAQ monitor does not receive power, configure, the at least one IAQ monitor as being installed within the enclosed space.

16. The HVAC system of claim 9, wherein the HVAC system comprises a residential system.

17. A heating, ventilation, and air conditioning (HVAC) system comprising:

at least one indoor air quality (IAQ) monitor positioned within at least one of a ductwork of the HVAC system and an enclosed space;

a controller configured to:

monitor operation of the HVAC system;

determine whether power exists at a duct terminal of the at least one IAQ monitor;

responsive to a determination that the power exists at the duct terminal of the at least one IAQ monitor, configure, the at least one IAQ monitor as being installed within the ductwork; and responsive to a determination that the duct terminal of the at least one IAQ monitor does not receive power, configure, the at least one IAQ monitor as being installed within the enclosed space.

18. The HVAC system of claim 17, wherein:

the at least one IAQ monitor is installed via a mounting bracket, wherein the mounting bracket comprises:

a first input terminal that receives power from a 24V transformer of the HVAC system;

a second terminal that is configured to provide a path back to the 24V transformer of the HVAC system; and the duct terminal provides a signal to the controller representing a location of the at least one IAQ monitor within the HVAC system based upon whether the duct terminal is powered or not.

19. The HVAC system of claim 18, wherein the duct terminal is powered via the first input terminal using an electrical wire.

20. The HVAC system of claim 19, wherein the electrical wire comprises a jumper wire.

* * * * *